US006263157B1

(12) United States Patent
De' Longhi

(10) Patent No.: US 6,263,157 B1
(45) Date of Patent: Jul. 17, 2001

(54) INDEPENDENTLY OPERATING AND MOBILE RADIATOR AND PROCESS FOR ITS MANUFACTURE

(75) Inventor: Giuseppe De' Longhi, Treviso (IT)

(73) Assignee: De'Longhi S.P.A., Treviso (IT)

( * ) Notice: Subject to any disclaimer, the term of this patent is extended or adjusted under 35 U.S.C. 154(b) by 0 days.

(21) Appl. No.: 09/311,046

(22) Filed: May 13, 1999

(30) Foreign Application Priority Data

Jun. 10, 1998 (IT) ..... MI98A01314

(51) Int. Cl.[7] ..... F28F 3/00

(52) U.S. Cl. ..... 392/378; 392/373; 392/347; 165/130

(58) Field of Search ..... 392/357, 351, 392/347, 373, 377, 378; 165/129, 130; 237/16–18

(56) References Cited

U.S. PATENT DOCUMENTS

| | | | | |
|---|---|---|---|---|
| 692,365 | * | 2/1902 | Safford | 165/130 |
| 787,845 | * | 4/1905 | Kinnear | 165/130 |
| 1,757,534 | * | 5/1930 | Lindstrom et al. | 165/130 |
| 2,167,822 | * | 8/1939 | Anderson | 165/130 |
| 2,439,945 | * | 4/1948 | Morton | 165/130 |
| 2,455,688 | * | 12/1948 | Malickson | 392/378 |
| 4,211,278 | * | 7/1980 | Bennett et al. | 165/130 |
| 5,341,455 | * | 8/1994 | Longhi | 392/357 |
| 5,685,365 | * | 11/1997 | De'Longhi | 165/130 |

FOREIGN PATENT DOCUMENTS

| | | | | |
|---|---|---|---|---|
| 1032912 | * | 6/1958 | (DE) | 392/378 |
| 2318200 | * | 10/1974 | (DE) | 165/129 |
| 327760 | * | 6/1903 | (FR) | 165/130 |
| 91756 | * | 8/1968 | (FR) | 165/130 |
| 713085 | * | 9/1966 | (IT) | 165/130 |

* cited by examiner

*Primary Examiner*—John A. Jeffery
(74) *Attorney, Agent, or Firm*—Herbert Dubno

(57) ABSTRACT

The independently operating and mobile radiator including a body having a plurality of radiating members each defined by a first metal plate and a second metal plate mutually associated and by a central portion wherein heated fluid circulates at a temperature preset by a resistance, the radiating members are mutually connected through passage hubs for circulating the heated fluid inside said body, each radiating member has one region of its surface, external to the central portion, having a wall thickness equal to the thickness of the first and second metal plates.

14 Claims, 12 Drawing Sheets

INDEPENDENTLY OPERATING AND MOBILE RADIATOR AND PROCESS FOR ITS MANUFACTURE

BACKGROUND OF THE INVENTION

1. Field of the Invention

The present invention relates to an independently operating and mobile radiator and to a process for manufacturing the radiator.

2. Description of the Prior Art

At present, as known, there are several types of independently operating and mobile radiators such as radiators wherein circulating diathermal oil is heated by an electric resistance arranged inside the radiator casing.

These diathermal oil radiators usually have a number of radiating members mutually hydraulically connected by means of upper and lower hubs.

Each radiating member is constituted by a first metal plate and a second metal plate mutually associated in order to define a central portion wherein the diathermal oil circulates. In each radiating member, the surface portion extending outside the central portion where the oil circulates may have folds and/or channels and/or apertures on the double sheet metal defined by the mutual connection of the first and second plates. Those folds and/or channels and/or apertures are adapted to reduce the heat transmission from the central portion to the periphery of each radiating member.

In this manner the peripheral surfaces of the radiator are at a lower temperature than that of the heated oil circulating in the central portion.

In spite of its good operation, this type of radiator has a relatively high manufacturing cost and accordingly a high retail cost.

In fact, the provision of a grid above the radiator casing requires added workings of forming, storing, degreasing, painting and assembling of the grid thereby increasing costs due to the materials and to the added production steps.

OBJECTS OF THE INVENTION

Moreover, the above described prior art radiators have the inconvenience of being heavy which entails high shipping costs and is a hindrance for the end user when moving the radiator around the room.

The aim of the present invention is to eliminate the above inconveniences of the prior art radiators operating with diathermal oil.

An important object of the invention is to provide an independently operating and mobile radiator and a process for its manufacturing allowing a considerable saving of material for the manufacture of the radiator and thereby a lower weight of the radiator and easier handling by the user.

A further object of the invention is to provide an independently operating and mobile radiator and a process for its manufacture allowing the grid to be located directly on the upper portion of the radiating members of the radiator casing in order to eliminate any supplemental manufacture step and to reduce the manufacturing cost and therefore the retail cost of the radiator.

Still a further object of the invention is to provide an independently operating and mobile radiator and a process for its manufacturing allowing a greater convective motion and therefore a greater thermal exchange, with the same capacity of prior art radiators.

Still a further object of the invention is to provide an independently operating and mobile radiator and a process for its manufacturing allowing a greater circulation of ambient air and accordingly less time required to heat the room and a better overall efficiency of the radiator.

SUMMARY OF THE INVENTION

The above technical aim, as well as the above and other objects that will be more apparent hereinafter, are achieved by an independently operating and mobile radiator comprising heating means. The radiating members are mutually by at least a first metal plate and a second metal plate mutually associated and by at least one central portion wherein heated fluid circulates at a temperature preset by heating means, said radiating members being mutually connected through passage hubs for the heated fluid for its circulation inside the body. Each of the radiating members has at least one region of its surface, external to the central portion wherein the heated fluid circulates, having a wall thickness substantially equal to the thickness of said first metal plate and of said second metal plate.

BRIEF DESCRIPTION OF THE DRAWING

Further characteristics and advantages of the invention will be more apparent from the following description of the independently operating and mobile radiator and process for its manufacturing, according to the invention illustrated, by way of example in the accompanying drawing wherein.

DESCRIPTION OF THE PREFERRED EMBODIMENTS OF THE INVENTION

Figure 1:
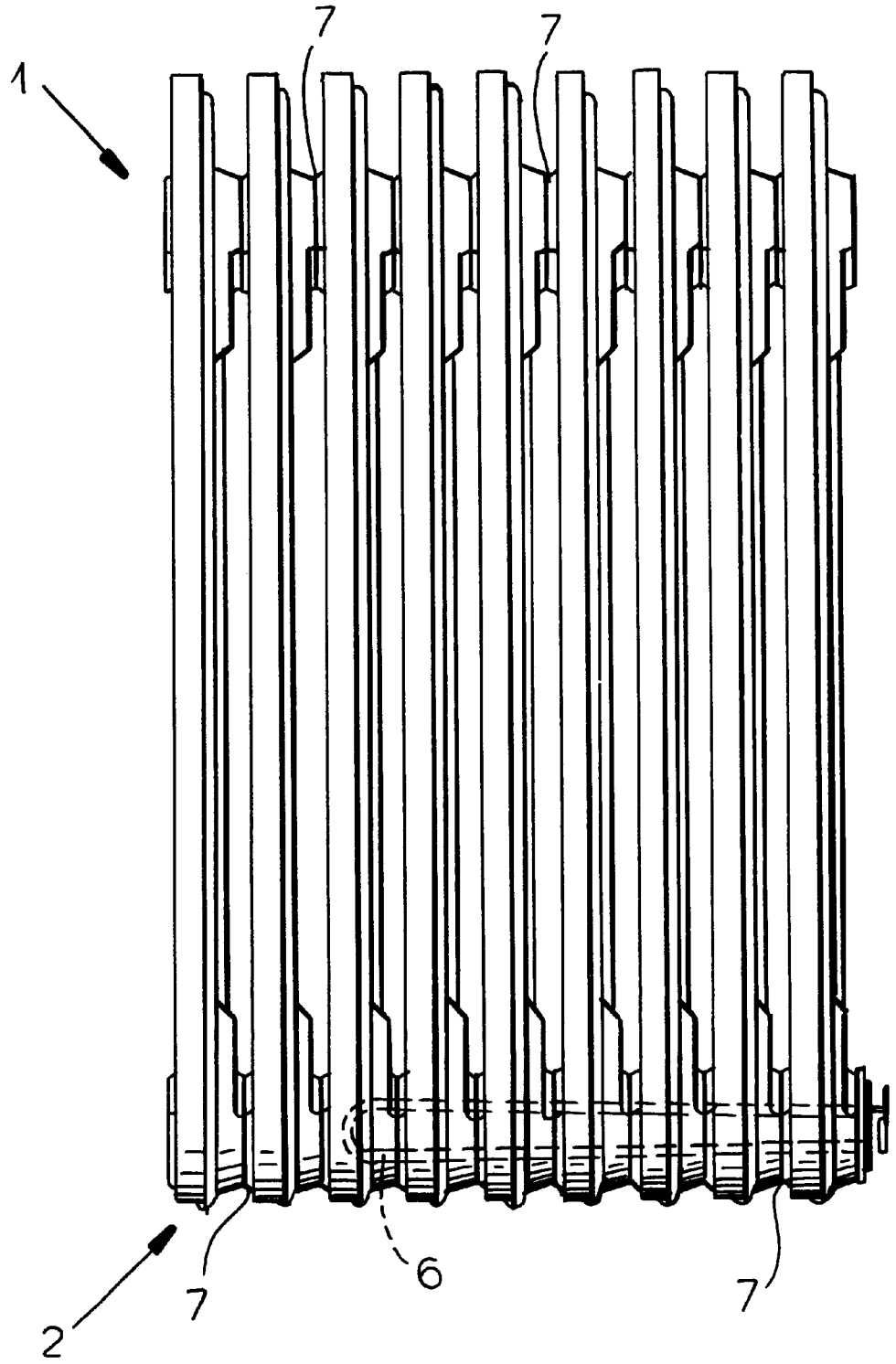
FIG. 1 is a side elevational view of the radiator body where, for example, the wheels for its movement are not illustrated.
Figure 2:
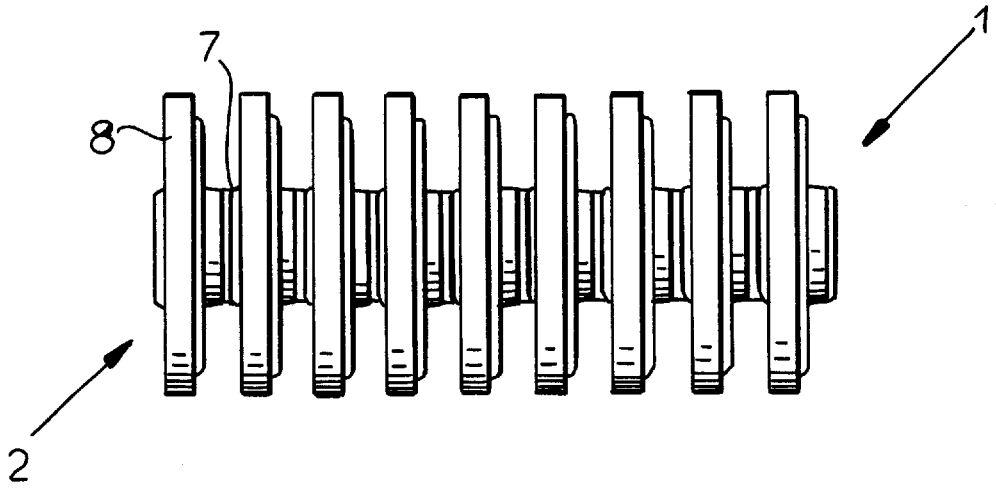
FIG. 2 is a top plan view of the radiator body shown in FIG. 1, according to the invention.
Figure 3:
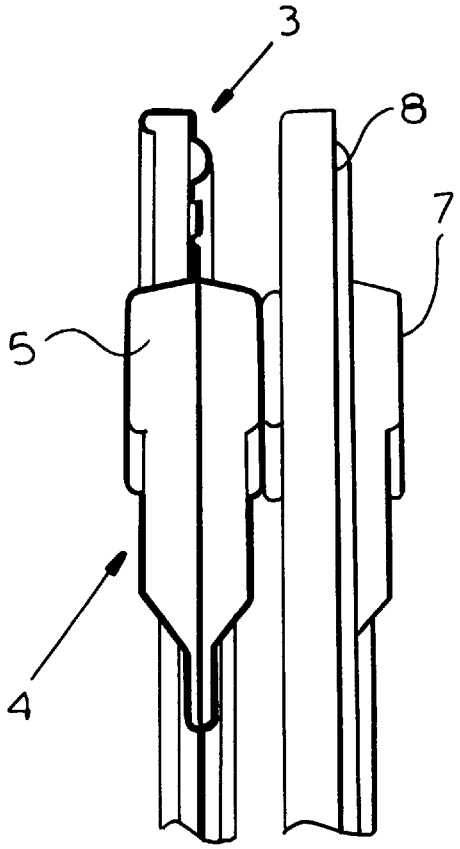
FIG. 3 is a side elevational view of the upper portion of two radiating members of the radiator wherein one member is cross-sectioned.
Figure 5:
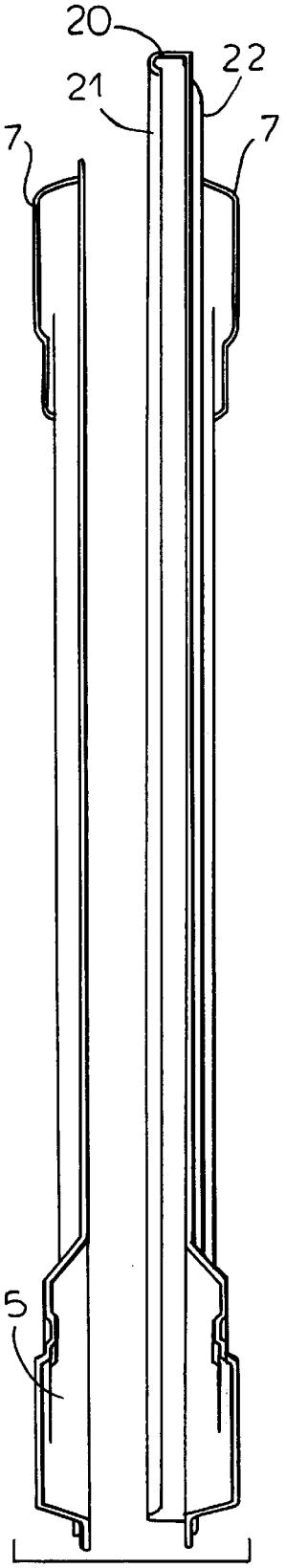
FIG. 5 is an exploded view of the first metal plate and of the second metal plate defining a radiating member of the radiator according to the invention.

With reference to the above figures, the independently operating and mobile radiator, globally designated by the reference numeral 1, comprises a body 2 defined by a plurality of radiating members each defined by at least a first metal plate and a second metal plate, globally designated by the reference numerals 3 and 4, and by at least one central portion 5 wherein fluid heated at a preset temperature by heating means, namely a resistance 6, circulates.

The radiating members mutually communicate through hubs 7 for the passage of heated fluid, for example a diathermal oil, allowing the fluid to internally circulate inside the body 2 of the radiator.

Advantageously, each radiating member has at least one region of its surface 8 external to the central portion 5 where the diathermal oil circulates, having a wall thickness "S" substantially equal to the wall thickness of the first or second metal plates 3 or 4.

In particular (FIGS. 6 to 8), the wall thickness "S" is made equal to the wall thickness of the first metal plate 3 or of the second metal plate 4 by the first metal plate 3 having greater size than the second metal plate 4 and comprising a seat means defined by a seat 10, having a size substantially similar to the size of the second metal plate 4, allowing the second metal plate 4 to be arranged in the seat 10.

Figure 7:
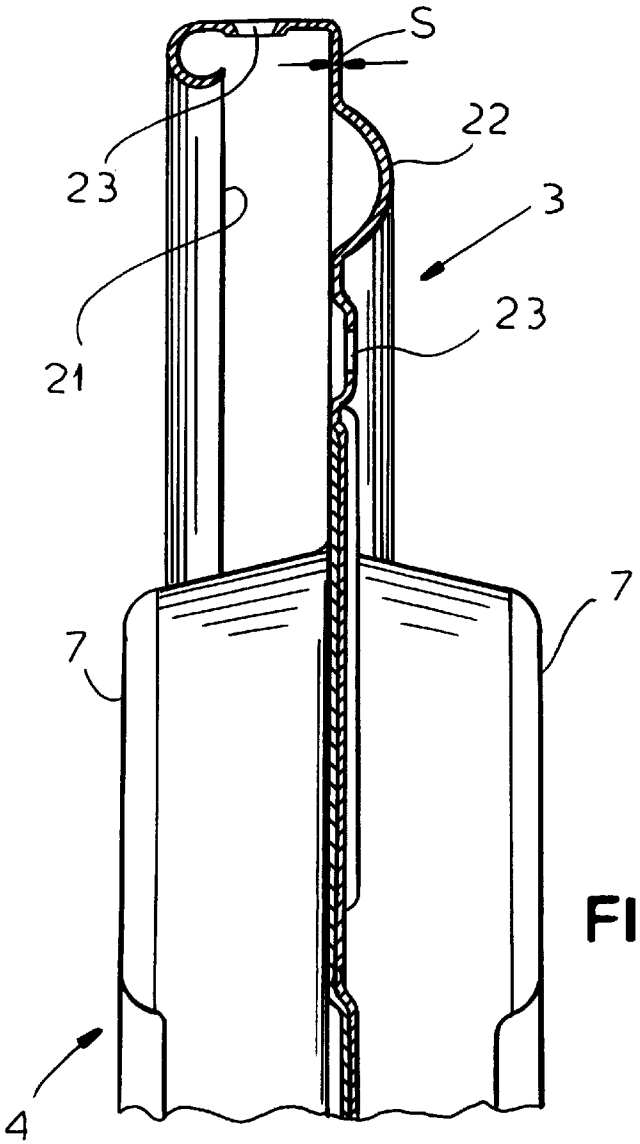
FIGS. 6 and 7 are sectional views showing respectively the first and second metal plates sectioned and mutually associated according to the invention.

In this manner, as clearly visible in FIG. 7, once the first and second metal plates 3 and 4 are mutually associated, the first plate 3 extends beyond the central region wherein the diathermal oil circulates from a median region thereof.

The second metal plate 4 is also associated with the first metal plate 3 by electric welding by rolling its peripheral region inside the seat 10 formed in the first metal plate.

In another embodiment, each radiating member has a tapered top thus having a substantially trapezoidal shape with the minor base 40 facing upwards and the major base 41 facing downwards for allowing the optimization of the convective air motion because the lower major base 41 defines an intake of greater size than the minor base 40 and thereby the cross section area of the air flow going from the base upwards is progressively smaller thus increasing the convective flow speed.

This embodiment allows a greater circulation of air in the ambient thus increasing the overall efficiency of the radiator.

Figure 9:
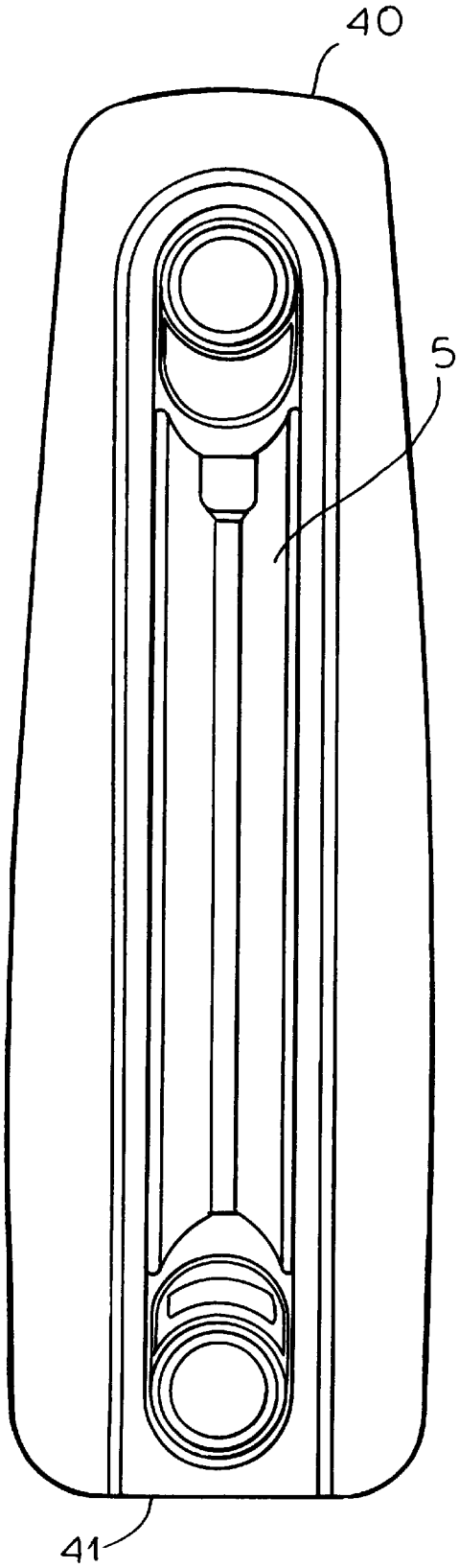
FIGS. 9 and 10 are a front view of a different embodiment of the radiating members of the radiator according to the invention.

In the embodiment schematically illustrated in FIG. 9, while the shape of each radiating member is, as mentioned above, substantially trapezoidal, its central portion 5 has extended and parallel sides, where the heated fluid, for example diathermal oil, circulates, i.e. the region where the first and second metal plates are welded together by rolling.

Figure 10:
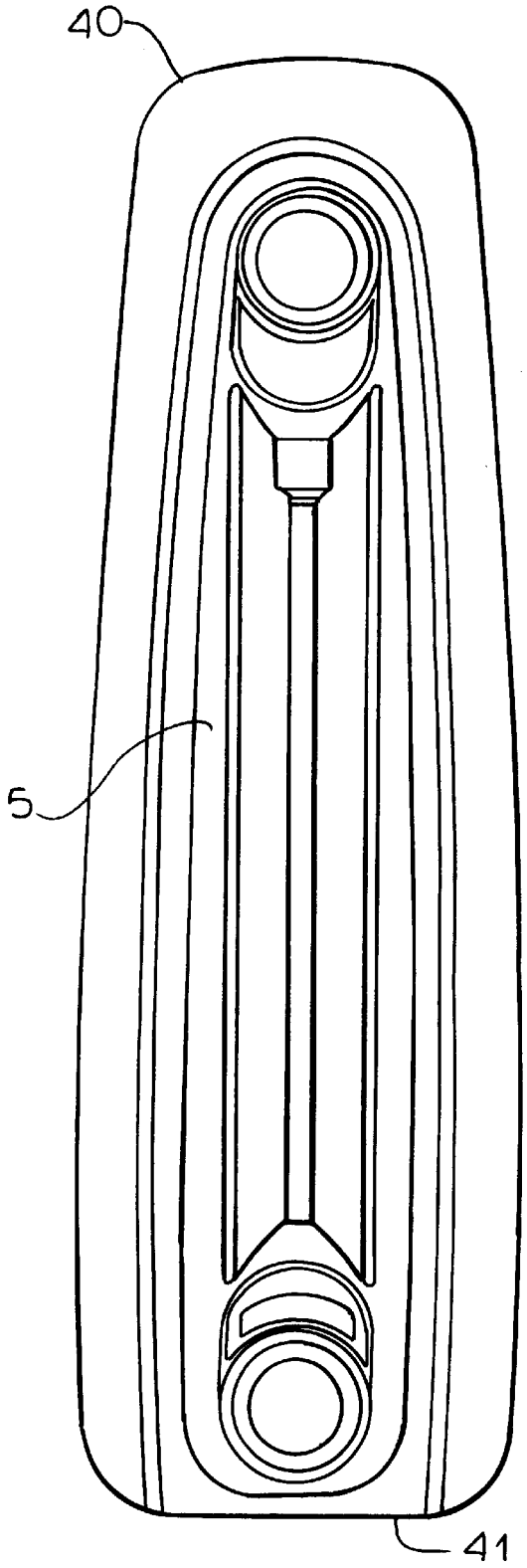

In a further variation, as schematically shown in FIG. 10, while the shape of the radiating member is still trapezoidal, the shape of its central portion 5, where the heated oil circulates, has its longitudinal sides substantially parallel to the edges of the radiating member such that also the central portion has a substantially trapezoidal shape.

Since the temperature on the edges close to the lower base 41 is lower, this last embodiment allows widening of the oil channel thus obtaining a greater efficiency of the radiator and equalizing its superficial temperature.

Figure 6:
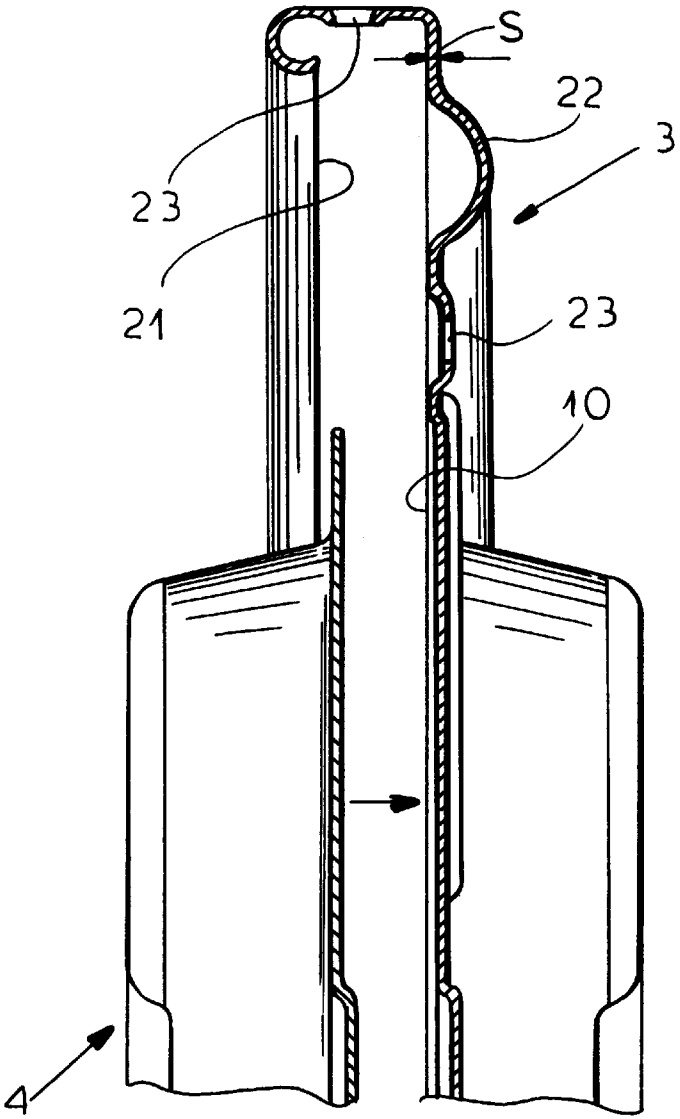
Figure 8:
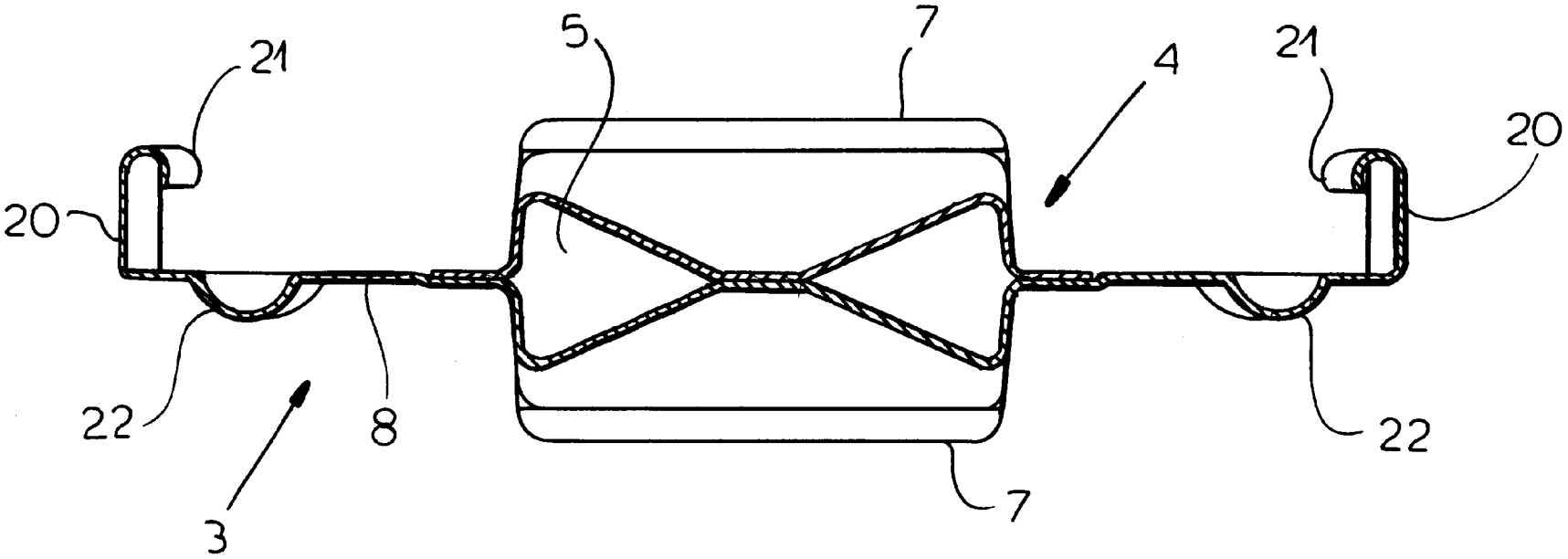
FIG. 8 is a section along line VIII—VIII of FIG. 4, according to the invention.

Both the above embodiments allow to mechanically work the first metal plate and it is for example possible to form at least a fold 20 on its peripheral portion, the fold having a ridge 21 on its edge (FIGS. 6 to 8).

The first metal plate has stiffening means on its surface and heat transmission limit means by convection from the central portion 5, where the oil circulates, to its edges.

Figure 4:
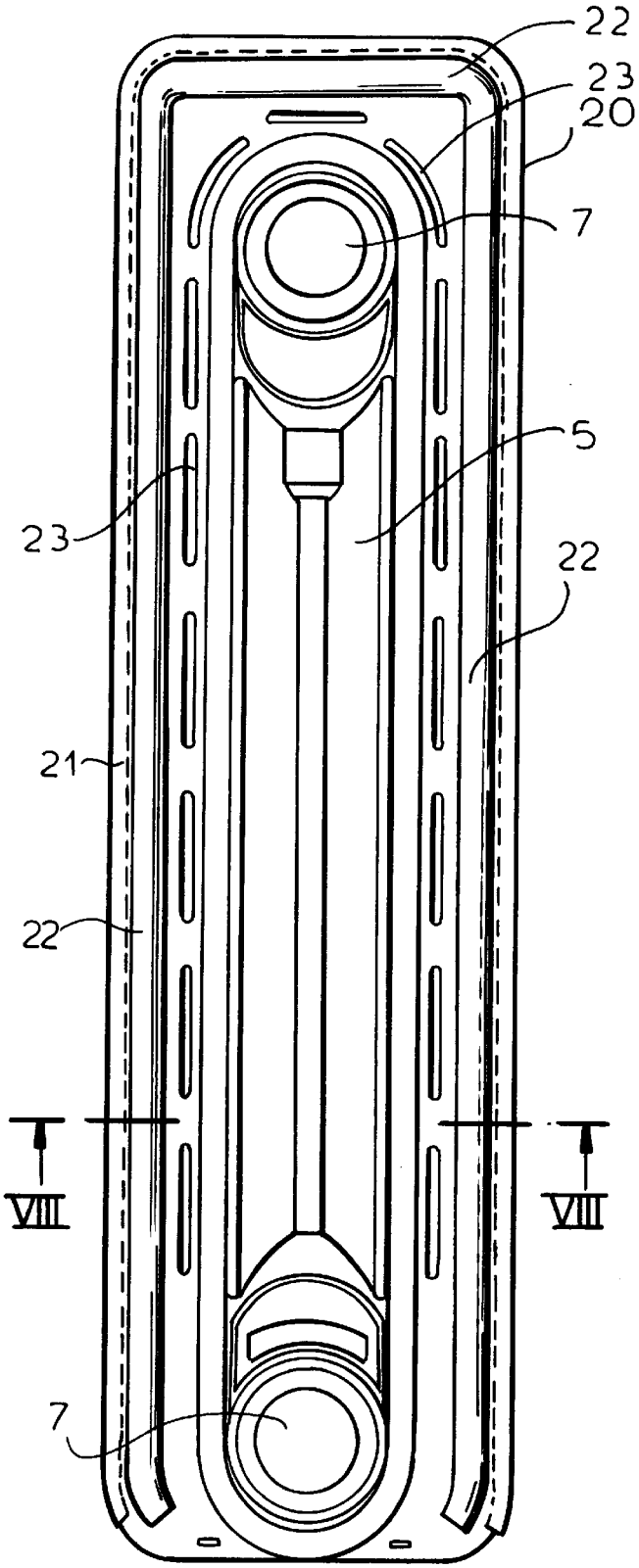
FIG. 4 is a front elevational view of a radiating member of the radiator according to the invention.

The stiffening means comprises a groove 22 extending at least along a portion of the first metal plate and in particular, as for example visible in FIG. 4, extending from the lower base along the entire perimeter of each radiating member.

The groove 22 has a semi-channel shape and also has the advantage of limiting the transmission of heat by convection from the central portion of each radiating member, because it increases the length of the path of the heat and accordingly increases the surface dissipating the heat, and because in the folded regions the sheet metal tends to be thinner thus increasing the passage of heat.

The heat transmission limit means may also be defined by one or more holes 23 which may be arranged parallel to the central portion where the oil circulates or at an angle or in any other suitable manner.

Buttonhole-shaped apertures or holes 23 are conveniently provided also on the upper portion of the radiator in such manner as to form a grid directly provided on the first metal plate 3 of each radiating member of the radiator in order to prevent the further manufacturing steps of the prior art such as forming, storing, degreasing, painting and assembling of the grids made separately from the radiating members and then associated with the radiating members once the radiator is completed.

Beside the provision of one or more elongated holes 23, adapted to form the grid, the upper portion of each radiating member may also be formed with the fold 20 and/or the ridge 21 of the first metal plate 3 in order to create a uniform radiator body equally provided with the above mentioned thermal and functional properties.

Because of the fact that in each radiating member an upper space is formed between the grid surface and the hubs wherein the heated fluid flows from one member to the other one, if necessary, the radiator may be provided also with forced flow means for forcing an air flow, such as for example a fan or air humidifier means, such as for example a humidifier, not illustrated.

One or both end radiating members may be provided with a cover, not illustrated in the drawing, adapted to close the body of the radiator both for styling and for preventing the contact with the heated portions of the radiator by the user.

The present invention also relates to a process for manufacturing an independently operating and mobile radiator as described and illustrated above.

Figure 12:
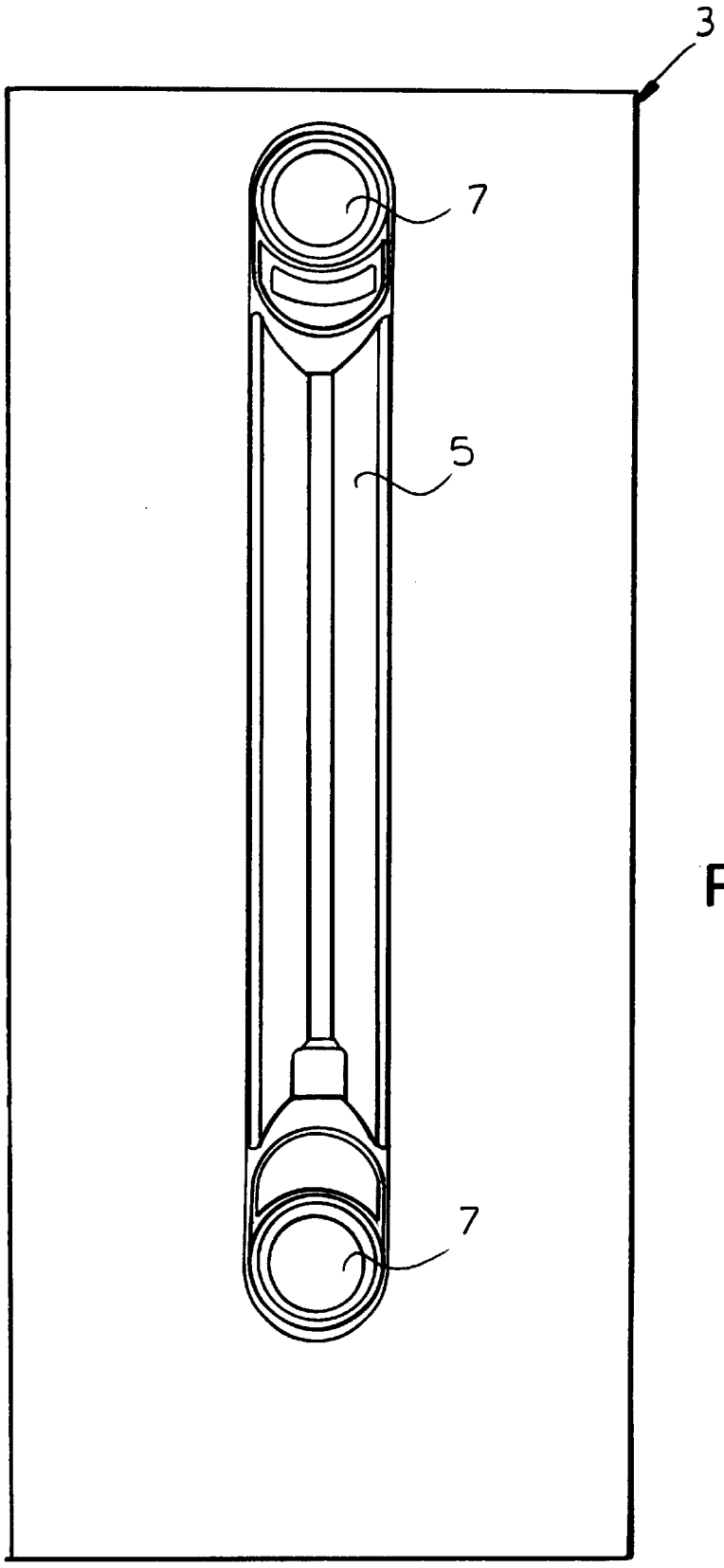
FIGS. 11 to 19 show the various manufacturing steps of each radiating member of the radiator according to the invention.
Figure 11:
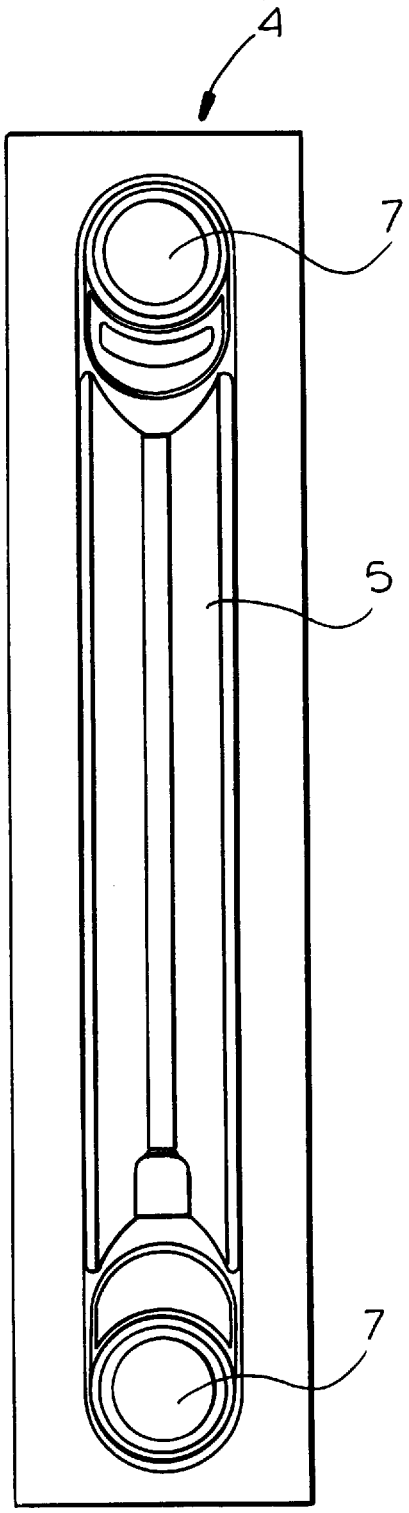

In particular, each radiating member is made by forming a first metal plate and a second metal plate having different dimensions. In particular, as described above, the first metal plate 3 shown in FIG. 12 has a size greater than the second metal plate 4 shown in FIG. 11.

By this forming operation, first and second longitudinal impressions are made on the first and second metal plates; the first and second impressions have the same shape and are adapted to define, as detailed herein after, the hollow 5 where the fluid to be heated by a resistance will circulate.

In particular, after the first and second longitudinal impressions have been made on the first and second metal plates, the plates are electrically welded together, by rolling, along a peripheral portion 50 of the second plate and the corresponding portion of the first plate.

Welding the first and second plates together allow superimposition of the first and second impressions or shapes thus creating the hollow 5 for the fluid to be heated.

Then, it is possible to mechanically work the first plate alone on its surface 8 extending externally to the oil containing hollow 5.

Figure 14:
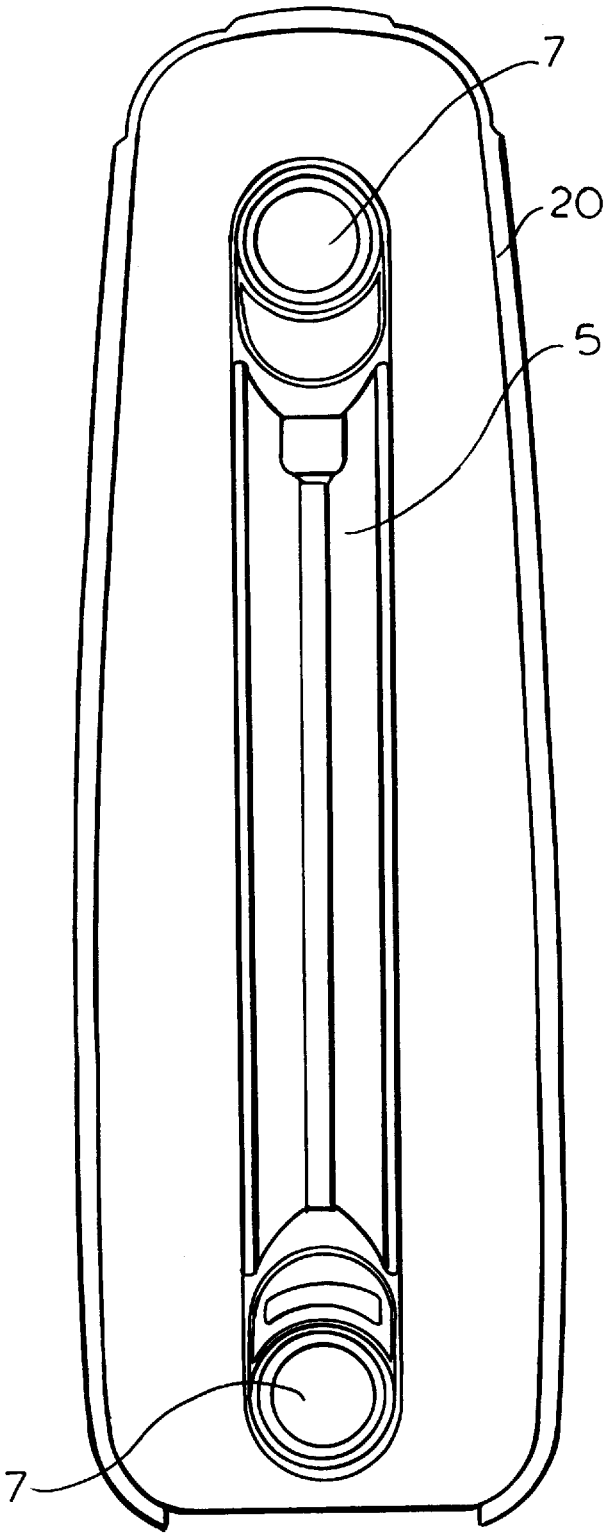
Figure 13:
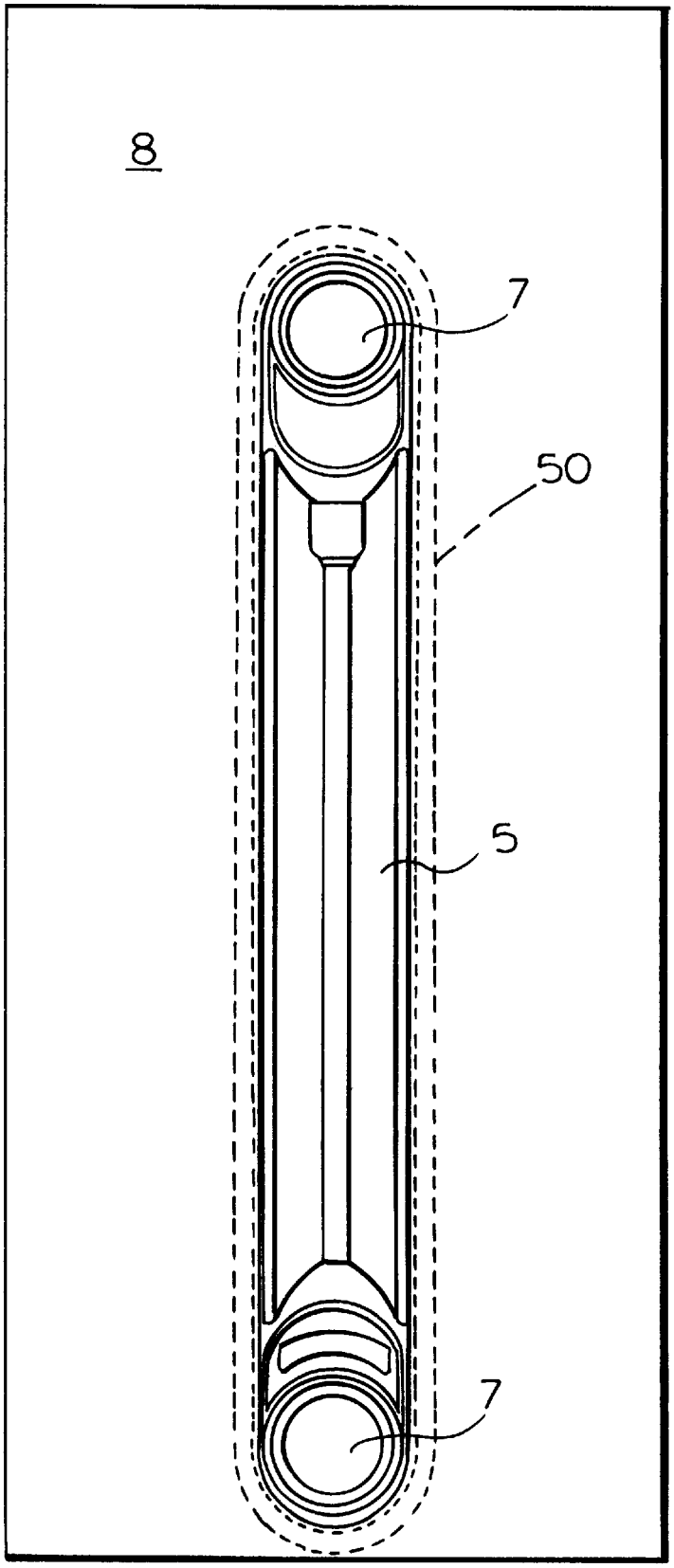

In particular, the mechanical working of the surface of the first plate, made for example on the radiator whose radiating member is shown in FIGS. 9 and 10, consists of at least one forming operation, shown in FIG. 14, and then a trimming operation of the first plate, as also shown in FIG. 14.

Figure 15:
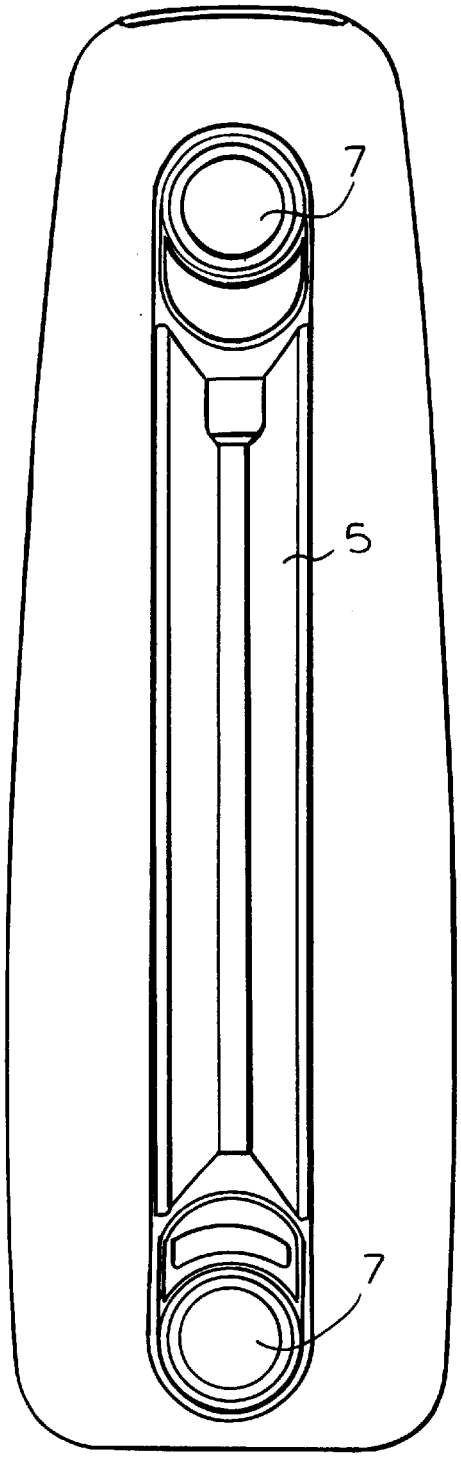
Figure 16:
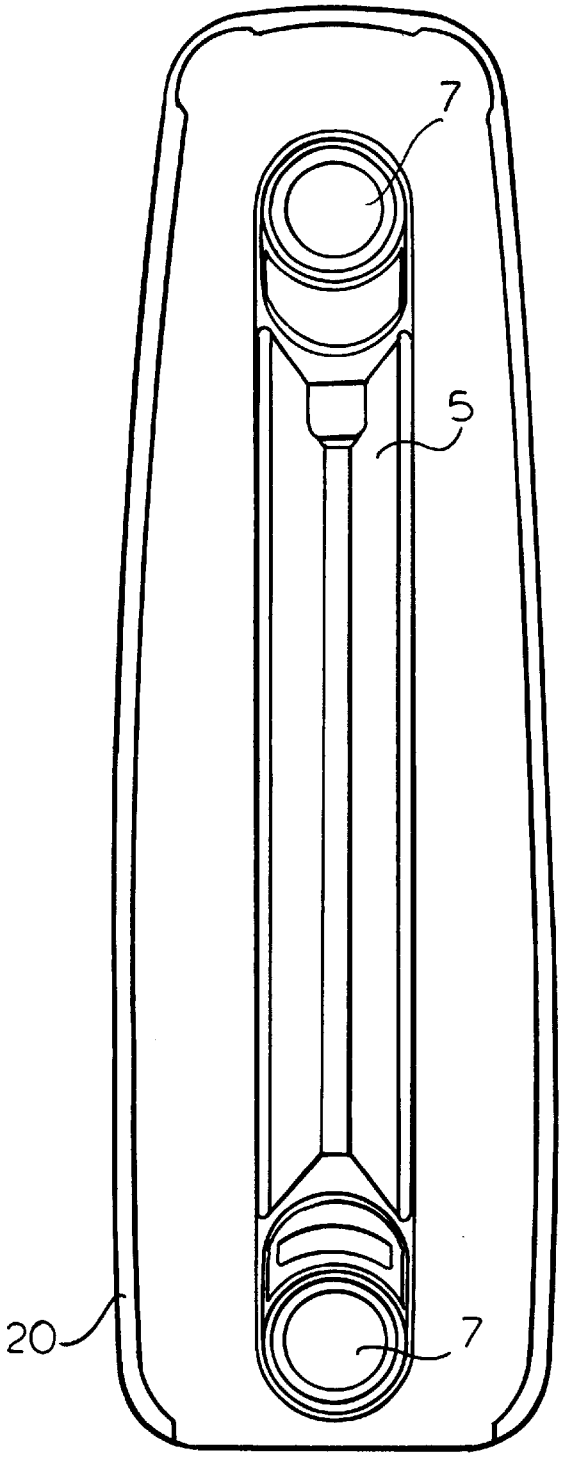
Figure 17:
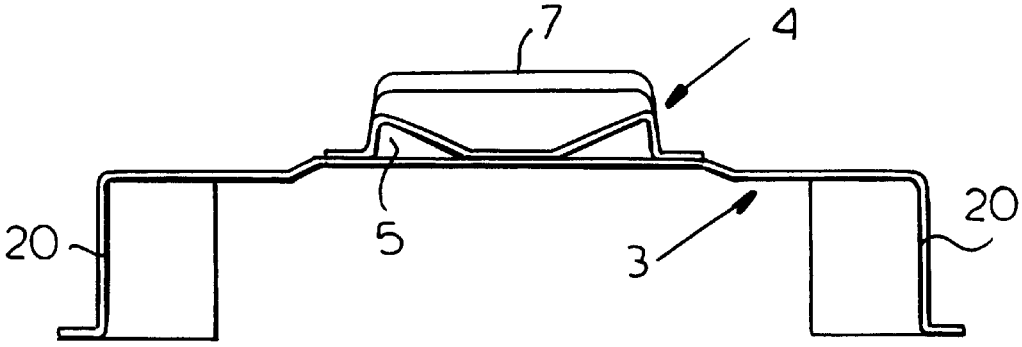
Figure 18:
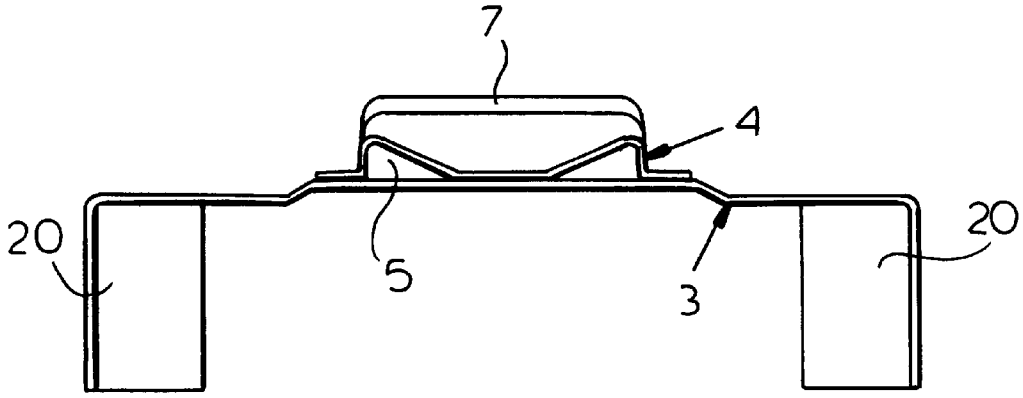
Figure 19:
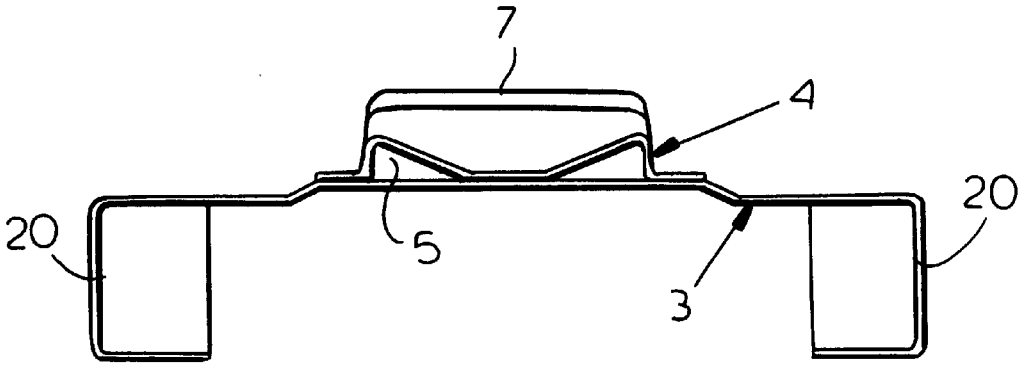

After the trimming operation, a straightening operation is performed, shown in FIG. 15, of the edge of the first plate and then a de-hemming operation of the trimmed edge as shown in FIG. 16.

The same type of operation, described above, up to the straightening operation, is then performed also on the radiating member, for example illustrated in FIGS. 6, 7 and 8.

Figure 20:
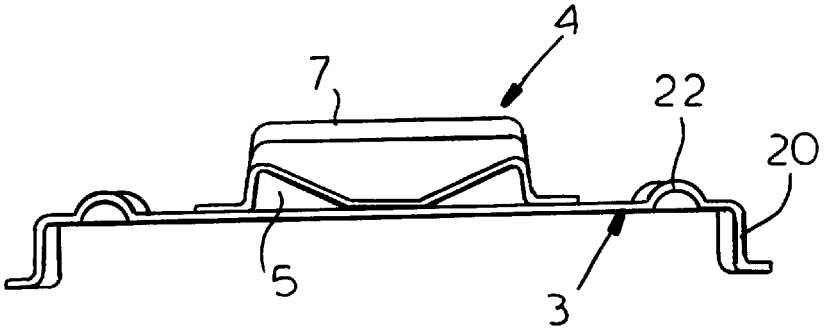
FIGS. 20 to 23 show the various manufacturing steps of each radiating member according to the radiator shown in FIG. 4.
Figure 21:
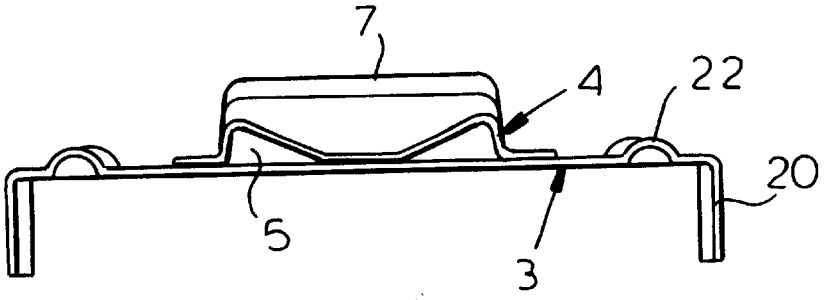
Figure 22:
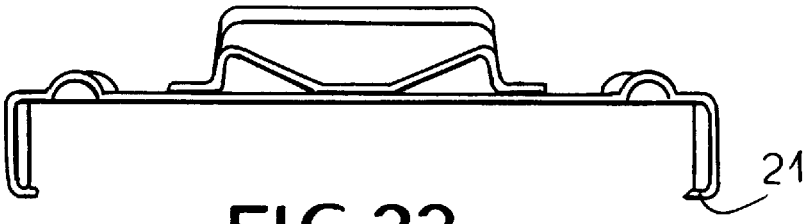
Figure 23:
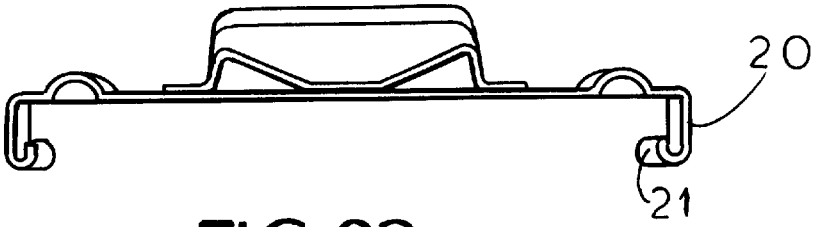

In this last case, after the forming and trimming operations (FIG. 20) and straightening operation (FIG. 21), a pre-curling operation is performed, shown in FIG. 22, and then a curling operation, as shown in FIG. 23, of the first plate.

In both cases, the cutting operation for forming the holes 23 on the first plate, both on the side of the heated fluid containing portion and above each radiating member for forming the grid directly on the radiating members, may be performed during any step, according to the requirements, after welding the first metal plate to the second metal plate.

It has been seen in practice that the radiator according to the invention is particularly advantageous in allowing to form a grid directly on the sheet metal of the radiating members thus eliminating the supplemental operations for providing the grid as in the prior art.

Performing the mechanical workings only on one plate allows to perform workings that are not possible on two plates as in the prior art radiators, and allows to manufacture of radiator which weighs less and is thus more easily moved from one room to the other by the user and also saves material in spite of improving its efficiency, the styling and the manufacturing speed in line.

The radiator according to the invention is susceptible to several modifications and variations within the inventive concept, also all the details may be substituted by other technically equivalent elements.

In practice, the materials employed, as well as the dimensions, may be any according to the specific needs and the state of the art.

What is claimed is:

1. An independently operating and mobile radiator comprising a plurality of radiating members each defined by a first and a second metal plate, the first metal plate having a recessed central portion and an outer portion extending outwardly of said central portion all around said central portion, the second metal plate fitting into said central portion and welded to said first metal plate around at least most of a perimeter of said central portion at which said metal plates adjoin with a thickness equal to a thickness of said first and said second metal plates, said first and second metal plates defining an upper and a lower passage hub communicating with a liquid circulation space within said central portion, said radiating members being connected in succession by the respective passage hubs, each of said radiating members having a thickness of only the respective first metal plate over the respective outer portion and outwardly of the respective perimeter, each of said outer portions having at least one bent flange extending over the second metal plate.

2. The radiator defined in claim 1 wherein said recess is a seat having a size substantially equal to a size of the respective second metal plate.

3. The radiator defined in claim 2 wherein said outer portion of said first plate lies in a plane of a median region of said liquid circulation space.

4. The radiator defined in claim 1 wherein said liquid circulation space has a taper from a narrower top portion to a wider base portion.

5. The radiator defined in claim 1 wherein each radiating member has an outer edge which is equidistant from the respective central portion.

6. The radiator defined in claim 1 wherein each first plate has at least one fold at the periphery thereof forming the respective flange.

7. The radiator defined in claim 6 wherein each fold is provided with a ridge along an edge thereof.

8. The radiator defined in claim 1 wherein each first plate is formed with stiffening means on a surface thereof and heat transmission limiting means limiting transmission of heat from said central portion to an edge of the respective first plate.

9. The radiator defined in claim 8 wherein each stiffening means comprises a respective groove extending at least along a portion of said first plate.

10. The radiator defined in claim 8 wherein said heat transmission means includes a groove formed in the respective first plate.

11. The radiator defined in claim 8 wherein said heat transmission means includes a plurality of holes formed in the respective first plate.

12. The radiator defined in claim 1, further comprising electric heating means in the radiator for heating the liquid.

13. The radiator defined in claim 1, further comprising forced flow means for inducing air flow between said radiating members.

14. The radiator defined in claim 1, further comprising air humidifying means for moisturizing air passing between said radiating members.

* * * * *